US009318817B2

(12) United States Patent
Hildebrand et al.

(10) Patent No.: US 9,318,817 B2
(45) Date of Patent: Apr. 19, 2016

(54) CABLE CONNECTORS OF AN ELECTRICAL MODULE

(71) Applicant: ZF Friedrichshafen AG, Friedrichshafen (DE)

(72) Inventors: Rainer Hildebrand, Friedrichshafen (DE); Heinz Reichert, Markdorf (DE)

(73) Assignee: ZF FRIEDRICHSHAFEN AG, Friedrichshafen (DE)

( * ) Notice: Subject to any disclaimer, the term of this patent is extended or adjusted under 35 U.S.C. 154(b) by 0 days.

(21) Appl. No.: 14/316,457

(22) Filed: Jun. 26, 2014

(65) Prior Publication Data

US 2015/0004852 A1 Jan. 1, 2015

(30) Foreign Application Priority Data

Jun. 26, 2013 (DE) ..... 10 2013 212 233

(51) Int. Cl.
*H01R 4/28* (2006.01)
*H01R 4/34* (2006.01)

(52) U.S. Cl.
CPC ..... *H01R 4/34* (2013.01)

(58) Field of Classification Search
CPC ..... H01R 11/281; H01R 11/24
USPC ..... 439/754, 755, 772–773, 770
See application file for complete search history.

(56) References Cited

U.S. PATENT DOCUMENTS

| | | | | |
|---|---|---|---|---|
| 5,075,813 | A | 12/1991 | Takabayashi | |
| 2006/0261751 | A1 | 11/2006 | Okabe et al. | |
| 2007/0081285 | A1 | 4/2007 | Takeshita et al. | |
| 2007/0091547 | A1 * | 4/2007 | Murakami | 361/627 |

FOREIGN PATENT DOCUMENTS

| | | | |
|---|---|---|---|
| DE | 103 31 416 | A1 | 1/2004 |
| DE | 10 2005 047 979 | A1 | 4/2007 |
| DE | 10 2007 008 098 | A1 | 10/2007 |
| DE | 10 2008 040 493 | A1 | 1/2010 |
| DE | 10 2011 075513 | A1 | 11/2012 |
| DE | 10 2011 080250 | A1 | 2/2013 |
| EP | 0 685 916 | A2 | 12/1995 |

OTHER PUBLICATIONS

Search Report dated Nov. 13, 2014 from corresponding DE Appln. No. 10 2013 212 233.0 (German language) (8 pages).

(Continued)

*Primary Examiner* — Phuongchi T Nguyen
(74) *Attorney, Agent, or Firm* — Brinks Gilson & Lione

(57) ABSTRACT

A device for mechanical and electrical connection of line wires in a cable to line connectors in an electrical assembly for a motor vehicle, wherein each line wire of the cable is connected to one line connector of the electrical assembly in such a manner that a form-locking unit, comprising a contact stud and a contact socket, is mechanically attached to the respective line connector via the contact stud, and furthermore, the respective line wire is mechanically attached to the contact stud of the form-locking unit, specifically providing an electrical contact between the line wire, the contact socket, and the line connector.

12 Claims, 2 Drawing Sheets

(56) References Cited

OTHER PUBLICATIONS

Figure 1:
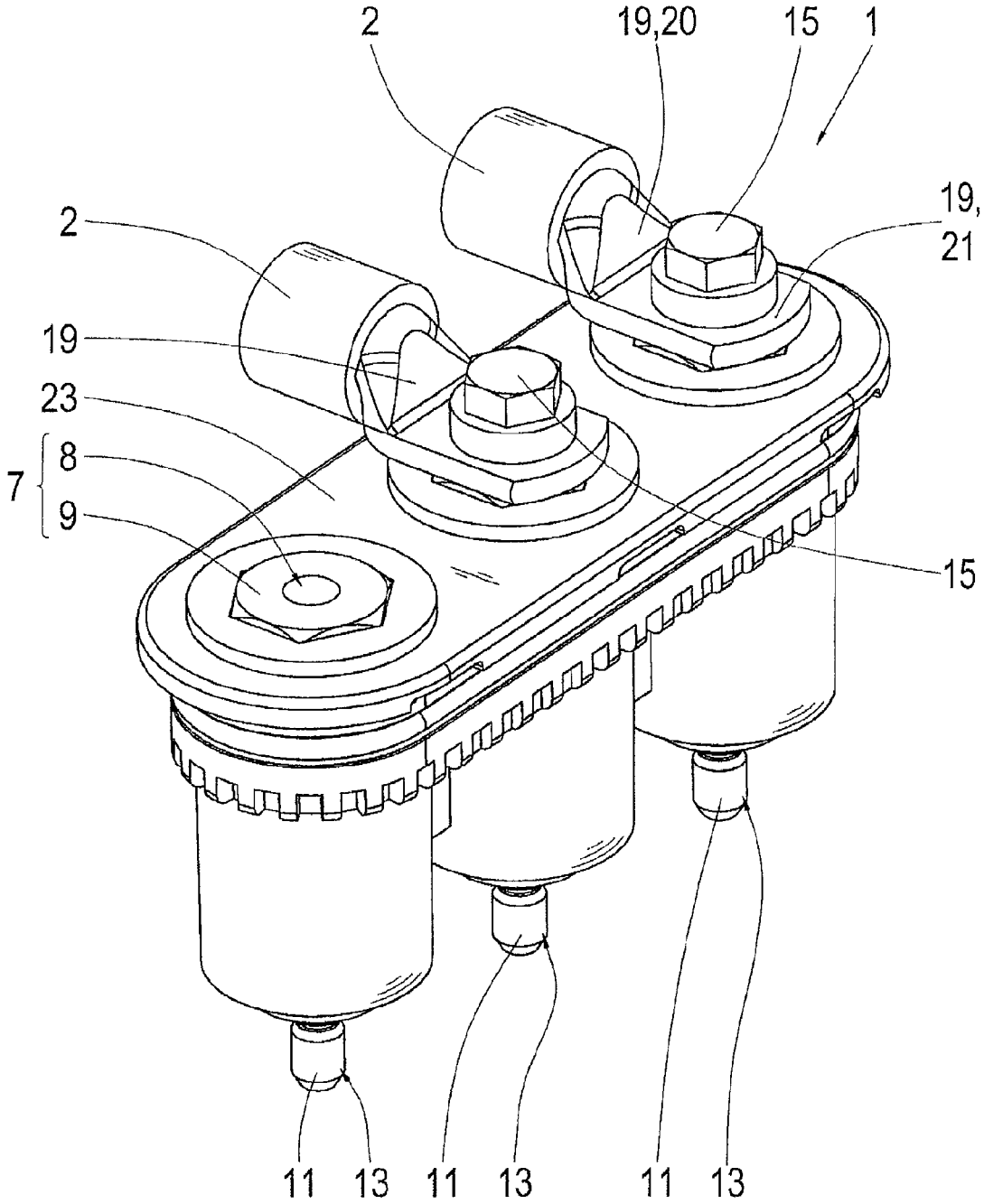

Translation of p. 8 of Search Report dated Nov. 13, 2014 from corresponding DE Appln. No. 10 2013 212 233.0 (2 pages).

International Search Report and Written Opinion issued Apr. 12, 2013 in International Application No. PCT/EP2013/050362 (German language) (9 pages).

International Search Report issued Apr. 12, 2013 in International Application No. PCT/EP2013/050362 (2 pages).

* cited by examiner

CABLE CONNECTORS OF AN ELECTRICAL MODULE

This application claims the benefit of German application DE 10 2013 212 233.0, filed Jun. 26, 2013. This application is incorporated by reference herein in its entirety.

The invention relates to a device for the mechanical and electrical connection of line wires in a cable to line connectors in an electrical assembly for a motor vehicle.

In motor vehicles, such as hybrid motor vehicles, for example, line wires in an electrical cable must be connected to line connectors in an electrical assembly at different positions, or in the region of different electrical assemblies, respectively, this being, on one hand, mechanically, and on the other hand, electrically. As such, the line wires, for example, of a three-phase electrical cable running between an electric machine of a hybrid drive and a power electronics system for the electric machine, must be mechanically and electrically connected to the electric machine, or the power electronics, respectively, both in the region of the electric machine as well as in the region of the power electronics.

The connection of a line wire in an electrical cable to a line connector in an electrical assembly by means of a screw, which engages, on one hand, with a wire shoe for the line wire, and on the other hand, with a busbar for the line connector, is known from DE 10 2008 040 493 A1.

The connection of line wires in a cable to line connectors in an electrical assembly by means of a continuous screw, known from the prior art, has the disadvantage that tolerances between the line wires in the cable and the line connectors in the electrical assembly cannot be, or can only be insufficiently, compensated for. Furthermore, a connection of this type, between the line wires in a cable and the line connectors in the respective electrical assembly, can only be insufficiently sealed.

Based on this, the present invention addresses the objective of creating a novel device for obtaining a mechanical and electrical connection of line wires in a cable to line connectors in an electrical assembly.

This objective is attained by means of a device for the mechanical and electrical connection of line wires in a cable to line connectors in an electrical assembly according to claim 1.

In accordance with the invention, each line wire in the cable is connected to a respective line connector in the electrical assembly, such that a form-locking unit comprising a contact stud and a contact socket is mechanically screwed to the respective line connector via the contact stud, wherein, furthermore, the respective line wire is mechanically screwed to the contact stud in the form-locking unit, specifically, while establishing an electrical contact between the line wire, the contact socket and the line connector.

The device according to the invention, for the mechanical and electrical connection of line wires in a cable to line connectors in an electrical assembly, enables a tolerance compensation between the line wires in the cable, the line connectors in the electrical assembly, and the housing belonging thereto. First, the respective contact stud is affixed to the respective line connector, and only then is the respective contact stud aligned with the housing, and fixed in place by the screwing thereof to the respective line wire.

As a result of the form-locking assembly of the contact socket and the contact stud, a secure and reliable contact between the busbar in the respective line connector and the contact socket can be established. Thus, a reliable mechanical and electrical connection of the line wires in a cable to the line connectors in an electrical assembly is possible, while ensuring a tolerance compensation.

According to an advantageous development of the invention, the contact stud in the respective form-locking unit, comprising a contact socket and contact stud, is mechanically screwed at one end to a nut allocated to the respective line connector, wherein a busbar allocated to the respective line connector is clamped between the contact socket in the respective form-locking unit and the nut in the respective line connector. This connection, of the contact stud to the electrical assembly, is simple and preferred.

According to an advantageous development of the invention, the respective line wire is mechanically screwed to the contact stud of the respective form-locking unit, comprising a contact socket and contact stud, by means of a screw, wherein the screw engages with a thread in a counter-thread of the contact stud, specifically at one end of the contact stud, which is opposite the end thereof at which the contact stud is screwed to the nut of the respective line connector. This connection of the contact stud to the line wire in the cable is simple and preferred.

Preferably the contact stud is inserted in a recess in the contact socket, wherein a rotation between the contact stud and the contact socket via a form-locking assembly of the contact stud and contact socket is impossible. The contact stud is preferably installed thereby in a form-locking manner in the contact socket by means of locking pin that passes through the contact stud and the contact socket. Alternatively, the contact stud is installed in a form-locking manner in the contact socket by means of a geometric profiling of the contact stud and contact socket. This structural design of the contact stud and contact socket is simple and preferred.

The respective assembled unit, consisting of a contact stud and contact socket, is preferably installed in a form-locking manner in the insulating bushing via a locally restricted profiling (e.g. hexagonal).

According to an advantageous development of the invention, all contact sockets in the form-locking assembled units, comprising a contact socket and contact stud, are inserted in an insulating bushing, wherein the bushing is sealed with respect to the contact sockets, and the contact sockets are sealed with respect to the respective contact studs. Preferably the bushing is inserted in a recess in a housing for the electrical assembly, and sealed with respect to the housing. By this means, a comprehensive sealing can be ensured in the region of the mechanical and electrical connection of the line wires in a cable with the line connectors for the electric machine. This development of the invention is therefore suited to, in particular, such applications in which the electrical assembly, to which the cable is to be connected, is designed as an electric machine integrated in a transmission for the motor vehicle. In this case it can then be prevented that media from the transmission, such as transmission fluid for example, escapes into the region where the cable is connected to the electric machine.

Figure 2:
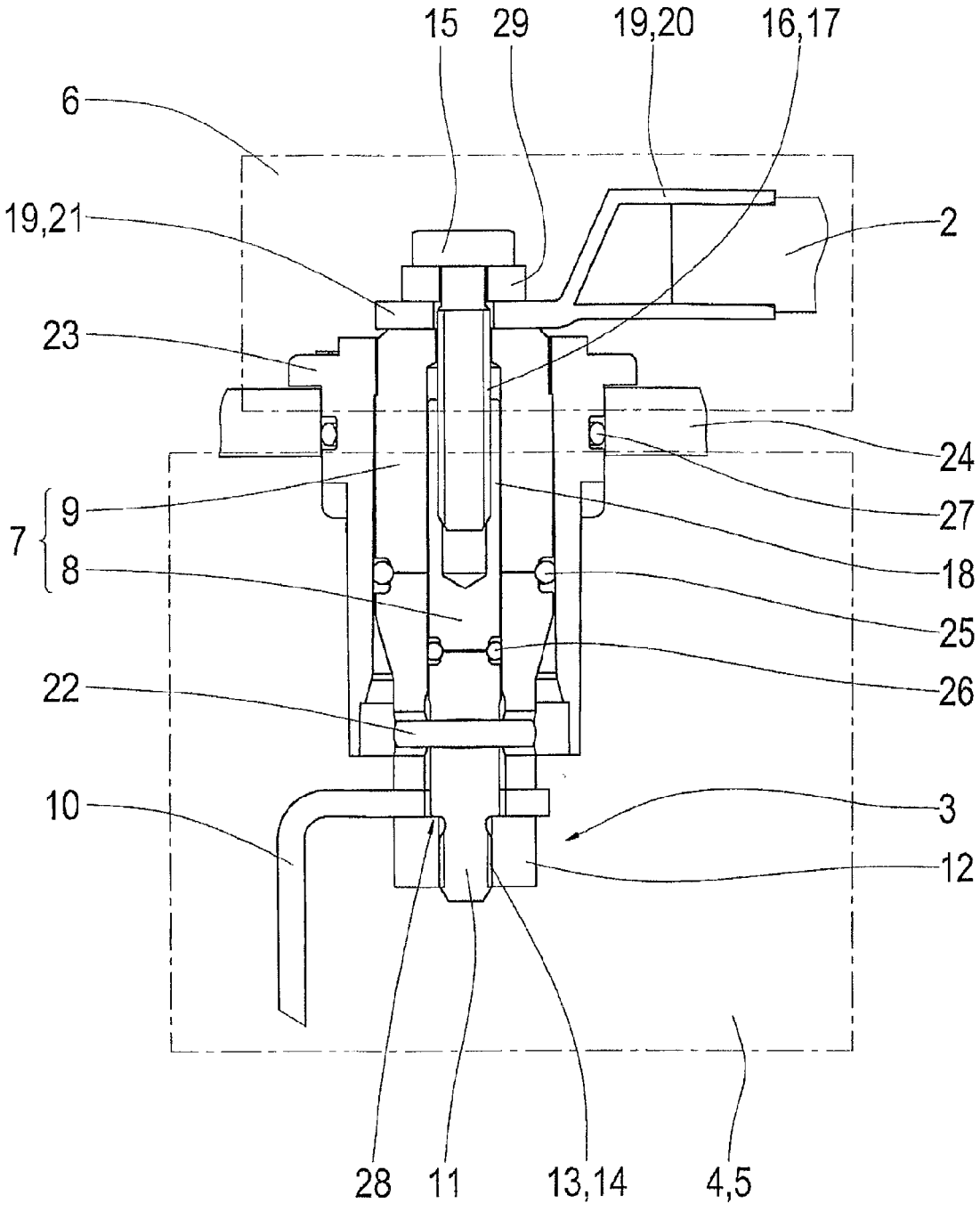

Preferred developments can be derived from the dependent claims and following description. Embodiment examples of the invention shall be explained in greater detail, without being limited thereto. Shown are:

FIG. 1 a perspective view of a device for the mechanical and electrical connection of line wires in a cable to line connectors in an electrical assembly; and FIG. 2 a cross-section cut through FIG. 1, together with a nut allocated to the respective line connector, and a busbar allocated to the same.

The invention relates to a device for a mechanical and electrical connection of line wires in a cable to line connectors in an electrical assembly for a motor vehicle.

In the following, the invention shall be described for the preferred application, in which the device serves for the mechanical and electrical connection of the line wires in a three-phase cable to the line connectors in an electrical assembly designed as an electric machine, which is integrated in a transmission in a hybrid motor vehicle.

It should be noted at this point, however, that the device can also be used for the mechanical and electrical connection of the line wires in a cable to line connectors in a power electronics assembly in the electric machine, or to line connectors in an electric energy storage unit in the hybrid motor vehicle.

FIG. 1 shows a perspective view of a device 1 for the mechanical and electrical connection of line wires 2 in a three-phase cable to line connectors in an electrical assembly, specifically having line connectors 3 for an electric machine 5 integrated in a transmission 4, wherein, in FIG. 1, only two line wires 2 of the electric cable are shown, and wherein, in FIG. 2, only one line connector 3 in the electric machine 5, integrated in the transmission 4, is shown.

The line wires 2 in the cable that are connected to the line connectors 3 in the electric machine 5 are accommodated in a line connector box 6.

Each line wire 2 in the cable is connected to the respective line connector 3 in the electrical assembly in such a manner that a form-locking unit 7, comprising a contact stud 8 and a contact socket 9, is mechanically screwed to the respective line connector 3 via the contact stud 8, wherein, furthermore, the respective line wire 2 is mechanically screwed to the contact stud 8 of the form-locking unit 7, specifically while establishing an electrical contact between the line wire 2, the contact socket 9 of the form-locking unit 7, and the line connector 3, specifically a busbar 10 allocated to the line connector 3.

With the assembly, or the establishing of the electrical and mechanical connection of a line wire 2 to the respective line connector 3, first the form-locking assembled unit 7, comprising a contact stud 8 and contact socket 9, is screwed to the respective line connector 3, wherein the contact stud 8 is screwed at one end 11 to a nut 12 allocated to the respective line connector 3 for this in the depicted embodiment example. For this purpose, the contact stud 8 has an external thread 13 at this end 11, which interacts with an internal thread 14 in the nut 12. Then, when the unit 7, comprising a contact stud 8 and contact socket 9, is screwed to the line connector 3 via the contact stud 8, the busbar 10 for the respective line connector 3 is positioned between the nut 12 thereof and the contact stud 9.

By means of the installation of the insulating bushing 23 over the respective units 7, said bushing is positioned in relation to the housing 24.

The respective line wire 2 is only then likewise mechanically screwed to the contact stud 8, specifically by means of a screw 15, wherein, as a result of the form-locking connection of the contact stud 8 and contact socket 9, a rotation between the contact stud 8 and contact socket 9 is prevented, and the busbar 10 for the respective line connector 3 is clamped in place between the nut 12 and the contact socket 9, establishing a good electrical contact between the busbar 10 and the contact socket 9.

The screw 15, which serves for the mechanical screwing of the line wire 2 to the contact stud 8, has an external thread 16, which interacts with a corresponding internal thread 17 in a hole in the contact stud 8. The screwing of the line wire 2 to the contact stud 8 in the respective form-locking unit 7 occurs at one end 18 of the contact stud 8, which lies opposite the end 11 thereof at which the contact stud 8 is screwed to the line connector 3 in the electrical assembly.

For the screwing of the respective line wire 2 to the contact stud 8 in the respective form-locking unit 7, a so-called wire shoe 19 is allocated to the respective line wire 2, which is affixed at a first section 20 to the respective line wire 2, wherein the screw 15 extends through a second section 21 of the respective wire shoe 19.

As has already been explained, the contact stud 8 is attached in a form-locking manner to the contact socket 9 of the respective unit 7, in order to thus establish the form-locking unit 7, comprising a contact stud 8 and contact socket 9, wherein the form-locking connection between the contact stud 8 and the contact socket 9 in the depicted embodiment example is established in that a locking pin 22 extends through the contact socket 9 and the contact stud 8 of the respective unit 7. The locking pin 22 prevents, accordingly, the rotation of the contact stud 8 received in the contact socket 9, and thus establishes the form-locking connection between the contact socket 9 and the contact stud 8.

Although the form-locking fixing of the contact stud 8 and the contact socket 9 in the respective unit 7 is preferably obtained by means of the locking pin 22, the form-locking attachment of the contact stud 8 to the contact socket 9 can, alternatively, also be implemented by means of a profiling of the contact stud 8 and the contact socket 9. As such, it is possible, for example, that the contact stud 8, which is inserted in a recess in the contact socket 9, as well as the recess in the contact socket 9, each have a component profile in the form of a square or a hexagon, in order to thus ensure the form-locking accommodation of the contact stud 8 in the contact socket 9.

As a result of the form-locking connection between the contact stud 8 and the contact socket 9, it can be prevented, in particular, that the screw connection between the line connector 3 in the electrical assembly and the contact stud 8 is released when the screw 15 has been loosened, i.e. when the screw connection between the line wire 2 in the cable and the contact stud 8 has been released. As a result of the form-locking connection between the respective unit 7 and the bushing 23, the reaction torque at the housing during the loosening and removing of the screw 15 can be supported.

The components of the device according to the invention serving for the mechanical connection, i.e. the nut 12, the contact stud 8, and the screw 15, are preferably made of steel. Accordingly, only assemblies made of steel are screwed to one another, such that a typical tightening torque can be used for the screwing together of the components.

According to FIG. 2, an optional step 28 on the contact stud 8 serves as a stop during the screwing, which limits the depth to which the contact stud 8 can be inserted in the respective nut 12 in the respective line connector 3. A stop of this type can also be established by means of an end of a thread in a larger thread. An optional spacer 29 is positioned between the screw 15 and the wire shoe.

The contact socket 9 is preferably made of copper, in order to ensure a good electrical conductivity between the wire shoe 19 on the line wire 2 and the busbar 10 for the line connector 3.

Each line wire 2 is accordingly connected to the respective line connector 3 by means of a form-locking unit 7, comprising a contact stud 8 and a contact socket 9, wherein the mechanical connection is primarily established via the respective contact stud 8, and wherein the electrical connection is primarily established via the respective contact socket 9.

All contact sockets 9 in the form-locking unit 7 are preferably accommodated in a collective insulating bushing 23, or inserted in a collective insulating bushing 23, respectively, wherein the insulating bushing 23 is placed in a recess in a housing 24. This housing 24 establishes the interface between the electric machine 5 integrated in the transmission 4 and the line connector box 6 in the depicted embodiment example.

According to FIG. 2, the bushing 23 is sealed off from the contact socket 9 by means of a sealing element 25, and furthermore, each contact socket 9 is sealed off from the respective contact stud 8 by means of a sealing element 26. Moreover, the bushing 23 is sealed off from the housing 24 by means of a sealing element 27.

By means of these sealing elements 25, 26, 27, it can be prevented by means of the device, which serves for the mechanical and electrical connection of the line wires 2 in the cable to the line connectors 3 in the respective electrical assembly, that media from the region of the electrical assembly is able to end up in the environment. As such, it can be prevented, with a machine 5 integrated in a transmission 4, that transmission fluid escapes and ends up in the region of the line connector box 6 by means of the device 1.

Although a shared insulating bushing 23 is preferred, for simplifying the assembly, each of the form-locking units 7 can also be accommodated in an individual insulating bushing, and placed via said bushing in a corresponding recess in the housing 24.

REFERENCE SYMBOLS

1 device
2 line wire
3 line connector
4 transmission
5 electric machine
6 line connector box
7 unit
8 contact stud
9 contact socket
10 busbar
11 end
12 nut
13 thread
14 thread
15 screw
16 thread
17 thread
18 end
19 wire shoe
20 section
21 section
22 locking pin
23 insulating bushing
24 housing
25 sealing element
26 sealing element
27 step
28 spacer

The invention claimed is:

1. A device for mechanically and electrically connecting a line wire of a cable with a line connector in an electrical assembly for a motor vehicle, the device comprising:

a form-locking unit comprising a contact stud and a contact socket, the form-locking unit capable of being mechanically attached to the line connector via the contact stud, such that when the line wire connector is mechanically attached to the contact stud the line wire is electrically connected between the contact socket and the line connector;

wherein the contact stud is formed in a recess in the contact socket; and wherein a form-locking connection of the contact stud and the contact socket is configured to prevent rotation between the contact stud and the contact socket.

2. The device according to claim 1, wherein the contact stud is mechanically attached to a nut that provides an electrical connection to a line connector end, and the device further comprising a busbar clamped between the contact socket and the nut for the line connector.

3. The device according to claim 1, wherein the contact stud is installed in a form-locking manner in the contact socket by via a locking pin passing through the contact stud and the contact socket.

4. The device according to claim 1, wherein the contact stud is installed in the contact socket in a form-locking manner via a geometric profiling of the contact stud and the contact socket.

5. The device according to claim 1, wherein the line wire is mechanically attached to the contact stud via a wire shoe.

6. The device according to claim 1, wherein the line wire is mechanically attached to the contact stud by a screw, wherein the screw engages with a thread in a counter-thread at a distal end of the contact stud, wherein the nut of the line connector is mechanically attached to a proximal end of the contact stud.

7. The device according to claim 1, wherein the contact socket in the form-locking unit is placed in an insulating bushing, wherein the contact socket is installed in a form-locking manner with respect to the insulating bushing via a geometric profiling.

8. The device according to claim 1, wherein the electrical assembly is an electric machine integrated in a transmission for a hybrid drive of the motor vehicle.

9. The device according to claim 1, wherein the electrical assembly is a power electronics unit for an electric machine in a hybrid drive for the motor vehicle.

10. The device according to claim 1, wherein the electrical assembly is an electric energy storage unit for a hybrid drive in the motor vehicle.

11. The device according to claim 1, wherein the contact sockets of the form-locking unit are placed in an insulating bushing, wherein the insulating bushing is sealed off from the contact socket, and the contact socket is sealed off from the contact stud.

12. The device according to claim 11, wherein the insulating bushing is placed in a recess in a housing of the electrical assembly, and wherein the insulating bushing is sealed off from the housing.

* * * * *